United States Patent [19]

Williamson

[11] 4,210,336

[45] Jul. 1, 1980

[54] GAME WITH GAME BOARD AND PIECES

[76] Inventor: Violetta Williamson, 1423 Easton Ave., Bethlehem, Pa.

[21] Appl. No.: 941,153

[22] Filed: Sep. 11, 1978

[51] Int. Cl.[2] ..... A63F 3/00

[52] U.S. Cl. ..... 273/258; 273/257

[58] Field of Search ..... 273/249, 250, 251, 258, 273/261, 257

[56] References Cited

U.S. PATENT DOCUMENTS

| | | | |
|---|---|---|---|
| 977,485 | 12/1910 | Tercy | 273/258 |
| 1,254,380 | 1/1918 | Whitmore | 273/258 |
| 3,414,264 | 12/1968 | Schriber | 273/249 |
| 3,643,957 | 2/1972 | Bryant | 273/249 |
| 4,116,450 | 9/1978 | Darrell | 273/249 |

OTHER PUBLICATIONS

Ripley, "*Believe It or Not,* " Washington Post; Nov. 26, 1967.

*Primary Examiner*—Richard C. Pinkham
*Assistant Examiner*—Carl Moy
*Attorney, Agent, or Firm*—Ruth Moyerman

[57] ABSTRACT

A game apparatus including a game board and game pieces designed for two players is disclosed. The game board has a circular playing area comprising a plurality of zigzag game paths, each of which begins at the edge of the circle and terminates at the center. Individual game pieces are positioned around the circumference of the game board on the individual zigzag paths and also at the center of the circle on the game path terminus. The game pieces are moved, each on its own individual path, according to a set of rules governing each game piece. Rules are provided for "jumping" each other and "removing" opponent's pieces. The game paths sometimes intersect each other and sometimes lie alongside each other and the object of the game is achieved when the first game piece successfully traverses its pathway to the center. Further interest in the game is provided by the second set of game pieces located at the center circle and whose purpose is to "guard" the circle center.

6 Claims, 4 Drawing Figures

GAME WITH GAME BOARD AND PIECES

BACKGROUND OF THE INVENTION

1. Field of the Invention

This game relates to amusement devices and more particularly to games with definitely movable game pieces.

2. Description of the Prior Art

Games utilizing playing boards and movable pieces are well known. U.S. Pat. No. 4,026,557 to LeBrun et al. U.S. Pat. No. 3,776,554 to Capablanca et al and U.S. Pat. No. 1,254,380 to Whitmore are all examples of games in which game boards are employed. The boards may use endless mazes and paths such as LeBrun or Whitmore, or they may employ concentric circles such as U.S. Pat. No. 3,918,715 to Puglis.

However, none of the foregoing prior art references make specific reference to a game utilizing interconnecting, zigzagging paths or employ two sets of men by each player. Furthermore, it has been found that the public enjoys a game which is theme oriented. Thus the popularity of games such as "war" games (U.S. Pat. No. 2,464,819 to Lieberman would be an example of the latter). There is also a great need for games which are educational, stimulating interest in subjects with social value, and thus providing a useful benefit as well as entertainment value.

Therefore, there is a need for games which entertain and engage all age ranges, are simple to use, have few parts and also perform an educational service.

SUMMARY OF THE INVENTION

The aforementioned prior art deficiencies are overcome by the game board and game pieces of this invention.

The game of this invention may be adapted to many themes but one which is of most suitability is a political theme and the board may, therefore, become the "arena" of the political sphere. The playing of the game requires game pieces e.g. "candidates" to be positioned around the perimeter of the board with a circular playing area, each on his own zigzag path; thus tossing their hats in the ring. During the playing of the game, individual game pieces (top hats) suitably named such as "governor", "judge", "lawyer", "dark horse", etc. and identified by indicia are moved by each of two players along a zigzag path conveniently referred to as a political maze. To further carry forward the political theme, the game pieces are preferably in the shape of minature hats. The gams is played by two players, each of whom move one of the top hat candidates in turn according to a predetermined set of rules.

To add interest and to increase the intellectual nature of the game, certain pieces known as "campaign managers" are positioned at the inner edge of the zigzag course traveled by the "candidates" and their function is to prevent opposing candidates from entering the "ring". The winner of the game becomes the player who first has a candidate complete a course ending at the center of the circle.

The ability of individual pieces to "jump over" or "remove" opposing candidates is governed by a set of rules specific to that "candidate".

It is therefore an object of this invention to provide a game utilizing a game board and playing pieces intricate enough to amuse and entertain both adults and children.

It is yet another object of this invention to provide a game board and pieces which are readily adaptable to the political theme to enable interest to be maintained in the American political process.

It is yet another object of this invention to provide a game board apparatus which may be played by the mastery of a minimum of complicated rules but which, at the same time, allows a maximum intellectual endeavor.

These and other objects will be more readily apparent to those skilled in the art from a consideration of the following FIGS., description and exemplary embodiments.

DETAILED DESCRIPTION

Figure 1:
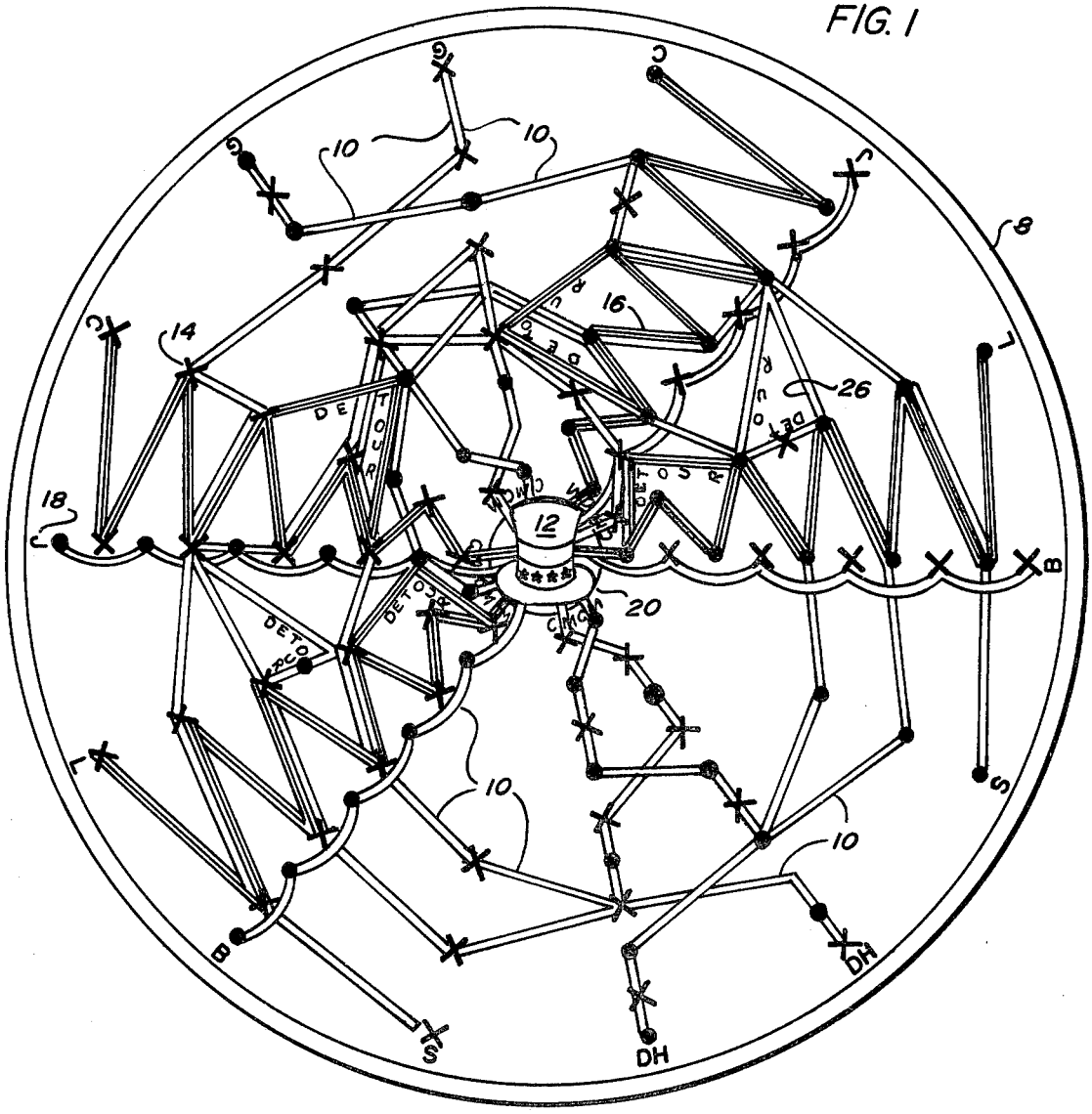
FIG. 1 represents a top plan view of the preferred embodiment of the game board of this invention.

Referring now to the drawings and more particularly to FIG. 1, 8 represents a game board playing area of this invention. Referring now to playing area 8, a series of zigzag paths 10 are shown. The board of FIG. 1 illustrates fourteen zigzag paths, but this number is optional. One end of zigzag path 10 is located proximate the perimeter of playing area 8 and the other end terminates in circle center 12. It should be noted that zigzag paths 10 intersect each other as for example at point 14, and in some instances lie alongside each other in a parallel fashion with lines touching each other as, for example, at point 16. As used herein, the term "zigzag" is meant to include lines connected both by a series of short, sharp turns or angles in the same or alternate directions and is also meant to include lines that are both straight and slightly curved or slightly angled.

The zigzag lines also include, in random fashion, dots and X's, which appear at various places along the paths. The purpose of these markings will be explained more fully hereinafter. Each game path also includes, at its beginning along the perimeter of circular playing area 8, a letter designation 18. There are seven letter designations in all and each appears two times. The letter designations illustrated in FIG. 1 are as follows: DH, S, B, L, C, and G. The purpose of the letter designations is to identify for the players the starting position of each playing piece. Each playing piece, as will be explained more fully hereinafter, also contains a like letter designation, thereby enabling the player to locate the piece on its position on the board.

Finally, a second set of letter designations, all of which are the same and in the example of FIG. 1, represented by the letters CM, appear at the center of the game board playing area as may be seen at letter designation 20. There are ten of these ring center designations and they all bear the same CM designation.

Figure 4:
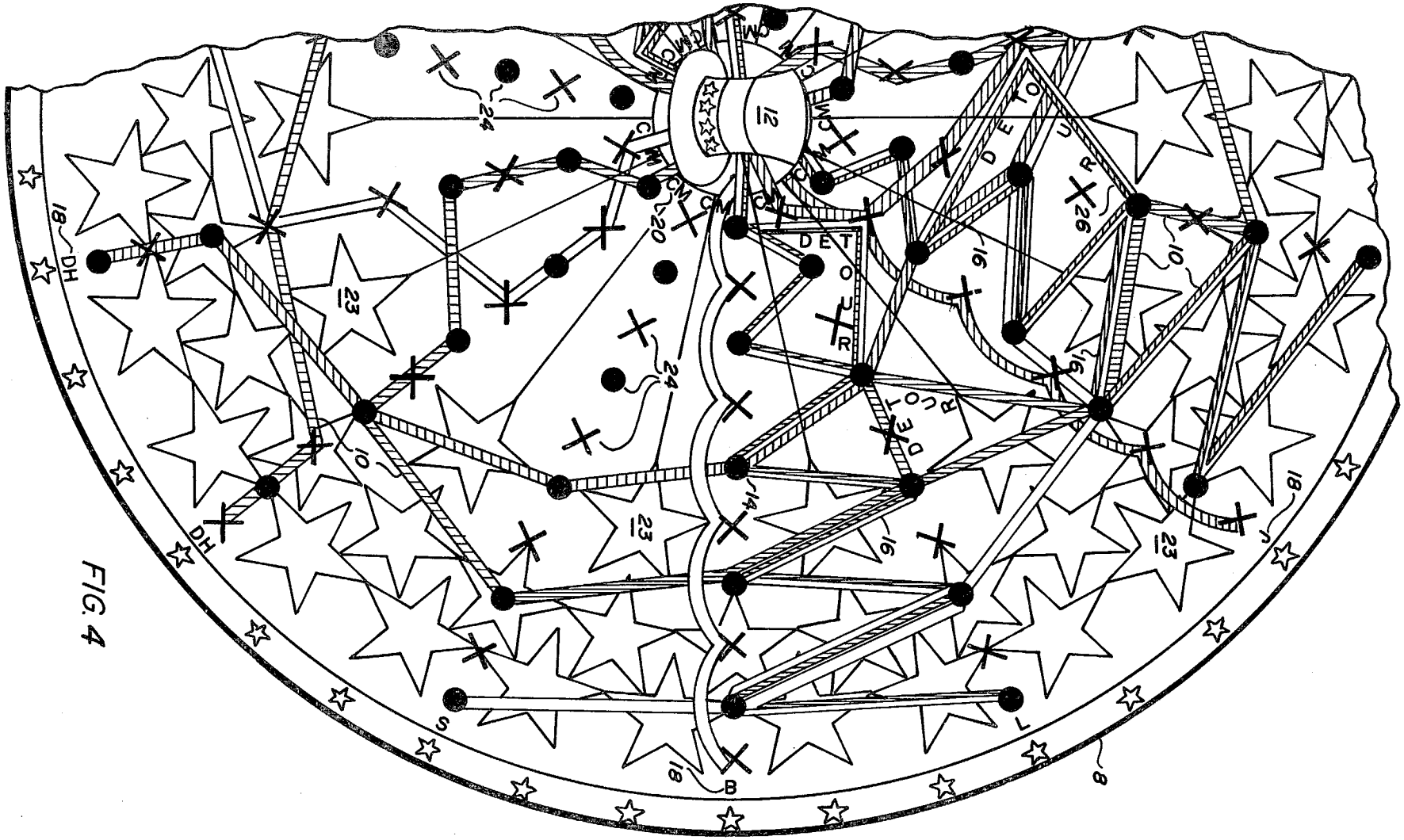
FIG. 4 is a fragmentary section illustrating a playing board of this invention including background decoration and color.

It should be appreciated that, in the playing of this game, each zigzag path must be distinguishable from its neighbor and that this result is most easily accomplished by the use of different colors or color combinations for each as will be more fully illustrated in FIG. 4.

It is most advantageous in the playing of a game of this nature to utilize a theme which will simultaneously add interest to the game, provide a socially useful function as a learning tool, and enable the players to more easily learn the rules. In the case of the preferred embodiment, a political theme is contemplated and, thus, the playing board becomes the "arena" of the political sphere. The zigzag paths indicate the difficult and confused paths that candidates must take on their way to achieve their object which is to reach the winner's circle first. Thus, the letter designations 18 may be as follows: L equals Lawyer, C equals Congressman, S equals Senator, J equals Judge, B equals Businessman, G equals Governor and DH equals Dark Horse. Letter designation 20 may be CM which equals Campaign Manager.

Figure 2:
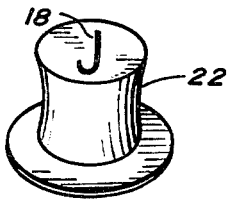
FIG. 2 is a perspective illustrating the preferred embodiment of one of the playing pieces of this invention.

Referring now to FIG. 2, one of the playing pieces 22 is illustrated. Playing piece 22, in keeping with the political theme of the game, is in the shape of a top hat. A playing piece may be conveniently about the size of a small thimble. Letter designation 18 is also plainly visible on the top of the top hat so that, during the playing of the game, the playing pieces are always readily identifiable by the player bending over the board.

At the beginning of play, each of two players has an identical set of playing pieces, for example, one representing a "blue" party and one a "red" party which, in the preferred embodiment, is one each of Lawyer, Congressman, Senator, Judge, Businessman, Governor and Dark Horse. These comprise the primary pieces and each player receives a set. To distinguish each player's pieces one set may be, for example, colored red and one blue. A second set of playing pieces is comprised of five Campaign Managers which are, for example, "white hats" bearing CM in the party color. Each player receives one set of five Campaign Managers. At the beginning of play, each player positions his set of primary and secondary pieces on the playing board on the designated spot, matching letter and color. The red, white and blue hat colors lend to the political theme. If color is used to distinguish between the two player's pieces it, therefore, follows that letter designations 18 and 20 on playing area 8 also appear in color so that each player will know which are his starting positions.

Once all the playing pieces are put on the board, the primary pieces at the perimeter and secondary pieces which are the Campaign Managers at the center, play is ready to begin. The player designated by the participants to begin first does so by moving one of the primary game pieces along its individual path to the next dot or X on the path according to a predetermined set of rules. Thereafter, the other player moves one of his men and play moves back and forth between the players in this fashion. The object of the game is for a player to move one of his pieces along its individual path without its being blocked or removed by an opposing player's piece. The first player's piece which traverses its entire individual zigzag from circle edge to circle center 12 wins.

In order to add interest to the game, pieces move according to rules designed for that individual playing piece. The following set of rules is exemplary.

1. A player may not move any one of his candidates the second time before he has moved two other candidates. Example: a player moves the Judge, Lawyer and Senator. He may now move the Judge again if he wishes; but he may not move the Lawyer or the Senator. This rule does not apply to the Campaign Managers. They may move any time.

2. No two candidates may occupy the same dot or X at the same time. No candidate moves from dot to X or from X to dot. (For exception to this rule see Lawyer and Congressman). If a candidate on a dot (X) finds an X (dot) in his path he passes over it and stops on his own dot or X. If it is occupied, see rule for Senator.

3. Each candidate moves on his own path. (For exception to this rule see Lawyer and Congressman).

4. BUSINESSMAN moves only when he can jump the opposing Lawyer and Dark Horse. He does not remove them.

5. CONGRESSMAN moves on his zigzag path. If he is on his 5th dot (X) when the opposing Dark Horse is on his 3rd last X (dot) he may move off of his zigzag path and remove the Dark Horse. His next move is back to his own zigzag path.

6. SENATOR removes the opposing Judge. He may jump and remove the opposing Senator. He may jump his own Judge and Dark Horse but does not remove them.

7. DARK HORSE removes the opposing Senator.

8. GOVERNOR may remove opposing Congressman where paths cross e.g. on the Congressman's 3rd dot (X). The Governor also removes the Dark Horse if he (Governor) is on his 6th dot (X) when the Dark Horse is on his 6th dot (X). The Governor removes him by taking the detour path.

9. JUDGE moves only when he can jump. He jumps his own Senator and opposing Congressman and Dark Horse; but does not remove them. He may remove the opposing Senator.

10. LAWYER moves on his zigzag path. If he is on his 4th last dot (X) when the opposing Judge is on his last X (dot) he may move off of his zigzag path and remove that Judge. His next move is back to his own zigzag path. The Lawyer also removes the opposing Senator and Governor.

11. CAMPAIGN MANAGER moves backward and forward on his dot (X) path. He may move from one candidate's path to another anywhere a dot (X) path meets his dot (X) path if he chooses. He may use the detour to pass from a dot to an X or from an X to a dot. His function is to block any candidate (opposing) from the winner's circle. He does so simply by blocking his move or by removing him.

12. Any candidate can remove any opposing Campaign Manager.

13. Opposing means any candidate of the other party.

14. Remove means remove only when you land on a dot or X occupied by a certain opposing candidate or Campaign Manager. See rules for which opposing candidate.

Figure 3:
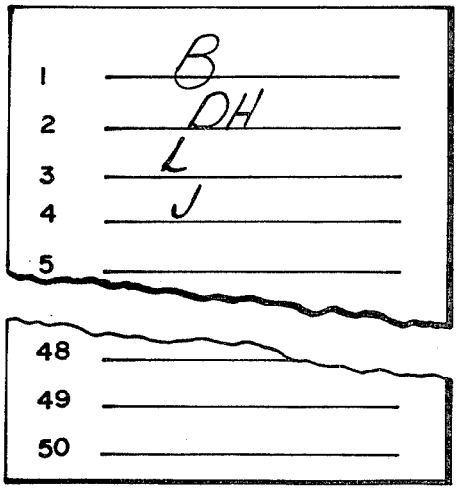
FIG. 3 illustrates a "track" sheet useful for playing this game.

In as much as during the course of play it is possible for a player to lose track of which piece he has moved last, a track record may be kept if needed. FIG. 3 illustrates a track record of candidate moves. The track record is nothing more than a sheet of paper with columnar numbers from one to however high a number is needed to complete a game, for example, fifty. Beside each number, in sequence of moves, the player writes the indicia indicating which player has been moved at that time. Thus, it may be seen that in FIG. 3 beside the number one, a player has written the letter B indicating that his first move was a Businessman and beside number two the H indicating that his second move was the Dark Horse. Number three indicates his third move was the Lawyer. Thus, a player may refresh his memory by referring to the track record and see that, by move number four, he is allowed to again move the Businessman since he has complied with the rule that no candidate be moved a second time before two other candidates are moved.

Referring now to FIG. 4, only a section of playing area 8 is shown. In FIG. 4, playing area 8 is shown including zigzags 10 as previously described in regard to FIG. 1 and, in addition, it includes a decorative background material such as stars 23. FIG. 4 is also illustrated as color coded so that it may be more readily apparent the advantage realized when color is utilized as a distinguishing feature to separate the zigzags from each other. The decoration shown in FIG. 4 also serves a utilitarian purpose in regard to the playing of the game in that it enables some visual confusion to be introduced for the purpose of increasing the concentration the players must employ to successfully win the game. It should also be noted in FIG. 4 that, in addition to the stars, certain dots and X's 24 also serve to further create visual confusion and, thus, necessitate concentration by the players.

FIG. 4 also shows, in greater detail, detour path 26. Detour path 26 is discussed in reference to the rules and provides interconnection between various paths to further increase combinations of possible moves available to a playing piece.

There are many variations which may be practiced within the scope of this invention. While a political theme has been illustrated, this invention is not intended to be limited to any particular theme. Thus, the name of the playing pieces as candidates and the uses of the colors red, white and blue are not meant to be limiting but merely illustrative of the possibilities for the expansion of the theme. Likewise, it should be understood that the designation of a top hat as the shape of the playing pieces is also optional.

The zigzag paths of playing area 8 may contain more or less paths, with correspondingly more or less playing pieces. It should also be appreciated that, while the zigzag path illustrated is a preferred embodiment, the paths may intersect each other or traverse the board in other pattern arrangements.

The keeping of a written track record for the purpose of indicating playing piece moves is also optional in the sense that, if a person is able to remember the order in which the pieces are played, it is unnecessary for him to keep this written record.

There are many advantages to the game of this invention. Primarily, it is suitable for both children and adults. Furthermore, the political theme illustrated by the preferred embodiment is of benefit in furthering the educational interest of the public in the political process.

Having now described and illustrated my invention, it is not intended that such description limit this invention, but rather that this invention be limited only by reasonable interpretation of the appended claims.

What is claimed is:

1. Game apparatus designed for two players in competition to move game pieces along preset paths according to rules comprising:

(a) primary game pieces, said game pieces comprising a plurality of different pairs of game pieces, each member of each pair bearing indicia of identification to distinguish it from its set mate and from one another within the set and, thereby, providing each of two players with an identical group of non-identical game pieces;

(b) secondary game pieces comprising two sets of a plurality of identical game pieces, each of said set members bearing indicia of identification to distinguish it from its set mate, thereby providing each of said players with an identical group of identical game pieces; and (c) a two-dimensional game board, said board's playing area being generally circular in shape and containing thereon a plurality of game piece paths in the form of zigzags, each of said paths commencing at a point on said circle's edge, said commencement points each bearing indicia corresponding to the indicia on a different one of said primary game pieces, and terminating at said circle's center, said number of paths corresponding to the total of said primary game pieces, said paths bearing demarcations indicating resting places for game pieces during play, some of said resting place demarcations immediately preceding said termination points bearing indicia corresponding to the indicia on said secondary pieces, said resting places so marked being equal in number to the number of secondary game pieces.

2. Game apparatus according to claim 1 wherein there are a total of fourteen game paths.

3. Game apparatus according to claim 1 wherein each of said zigzag paths intersects at least one other path.

4. Game apparatus according to claim 1 wherein said game pieces are generally in the shape of miniature hats.

5. Game apparatus according to claim 1 wherein said game board playing area utilizes decoration designed to increase visual difficulty in quickly identifying the course of a particular game path.

6. Game apparatus according to claim 1 wherein each player has a total of seven primary game pieces and a total of five secondary game pieces.

* * * * *